US008622333B2

(12) United States Patent
Dermo

(10) Patent No.: US 8,622,333 B2
(45) Date of Patent: Jan. 7, 2014

(54) TOILET TISSUE ROLL HOLDER CAPACITY EXTENDER

(76) Inventor: Mario Dermo, Warren, MI (US)

( * ) Notice: Subject to any disclaimer, the term of this patent is extended or adjusted under 35 U.S.C. 154(b) by 0 days.

(21) Appl. No.: 13/353,688

(22) Filed: Jan. 19, 2012

(65) Prior Publication Data

US 2012/0111989 A1 May 10, 2012

Related U.S. Application Data

(63) Continuation-in-part of application No. 12/887,001, filed on Sep. 21, 2010, now Pat. No. 8,201,770.

(51) Int. Cl.
*B65H 16/06* (2006.01)

(52) U.S. Cl.
USPC ..... 242/598

(58) Field of Classification Search
USPC ..... 242/598, 598.2, 598.3, 598.4, 598.5, 242/599, 599.1, 599.3, 599.4, 596.7, 597.5, 242/596, 596.8, 597.8
See application file for complete search history.

(56) References Cited

U.S. PATENT DOCUMENTS

| | | | | |
|---|---|---|---|---|
| 2,370,821 | A * | 3/1945 | Stott | 242/422.4 |
| 2,546,820 | A * | 3/1951 | Grant | 242/599.1 |
| 2,571,321 | A * | 10/1951 | Wettley | 242/599.4 |
| 5,718,404 | A * | 2/1998 | Greer | 248/309.2 |
| 7,316,369 | B2 * | 1/2008 | Phelps | 242/596.4 |
| 2007/0228209 | A1 * | 10/2007 | Burnett | 242/599 |

* cited by examiner

*Primary Examiner* — Sang Kim
*Assistant Examiner* — Juan Campos, Jr.
(74) *Attorney, Agent, or Firm* — Young Basile Hanlon & MacFarlane PC

(57) ABSTRACT

A toilet tissue roll holder extender which extends the roll diameter capacity of the holder by adhesively attaching flat plastic extender bodies to the inside surfaces of the conventional toilet tissue roll holder arms. In the preferred embodiment, the extenders have compound diameter spindle-receiving holes formed therein and the combination can be used with a toilet tissue core restoring insert of rigid plastic.

2 Claims, 3 Drawing Sheets

FIG. 1
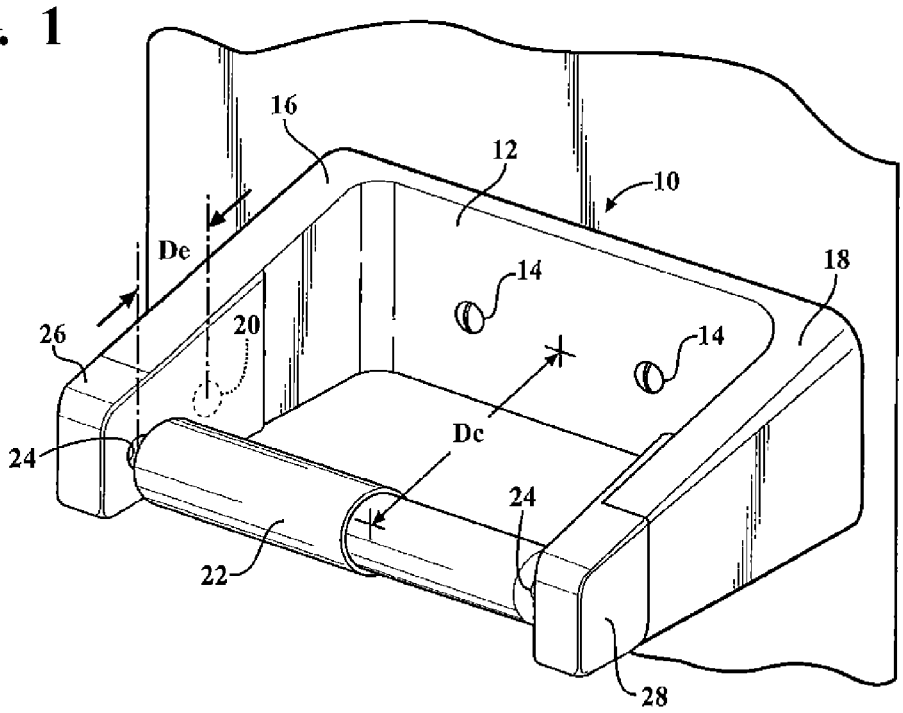
FIG. 2
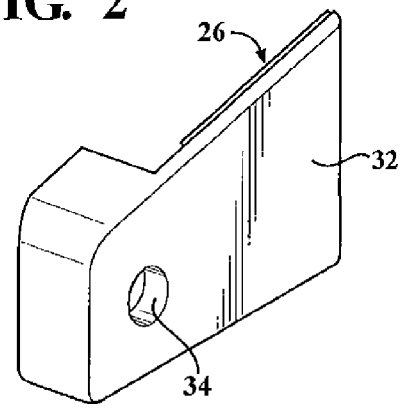
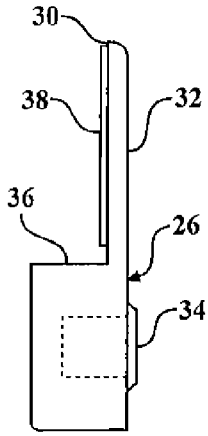
FIG. 3

TOILET TISSUE ROLL HOLDER CAPACITY EXTENDER

CROSS-REFERENCE TO RELATED APPLICATION

This application is a continuation-in-part of the co-pending U.S. patent application Ser. No. 12/887,001 filed Sep. 21, 2010 and claims the benefit of that application.

FIELD OF THE INVENTION

This invention relates to devices for increasing the roll diameter capacity of a toilet paper roll holder.

BACKGROUND OF THE INVENTION

Toilet paper roll holders are available in a variety of configurations including a one-piece construction comprising a base plate adapted to be attached by screws or adhesive to a wall or partition. Integral with said base plate are two outwardly extending, spaced-apart arms which are parallel to one another in use and may either be fixed or collapsible. A spindle (also called a "roller") is provided, resiliently adjustable in length for mounting between said arms, the opposite end pins of the spindle extending into receptacles near the outward distal ends of said arms.

Toilet paper roll holders are also available in various styles and comprising two totally separate posts which can be independently attached to a wall or partition. When mounted, a spindle is mounted between them to accommodate a roll of toilet paper.

In both of the roll holder types described above, the roll diameter capacity is limited by the distance between the spindle axis and either the base plate or the wall or partition. Toilet paper rolls are now available in "jumbo" size rolls of 5 or more inches in diameter, too large to be carried by some toilet paper roll holders; i.e., the outer surface of the roll hits the wall or base surface and will not rotate.

SUMMARY OF THE INVENTION

The present invention provides an apparatus for simply and inexpensively increasing the roll diameter capacity of any type of conventional toilet paper roll holder having opposed arms or posts adapted to receive a spindle therebetween.

In accordance with an illustrative embodiment of the invention, the extender bodies include an elongate, thin portion having a thicker section at one end. The thin portion has a continuous, flat inner surface and a stepped outer surface, the step defining the transition between the thinner and thicker sections. The thinner part of the stepped surface may also be provided with an adhesive, generally in the form of a two-sided tape with a protective layer in place prior to installation, to facilitate attaching the extender body to the inside surface of a conventional roll holder in a way that covers up the conventional spindle hole. Replacement holes, either blind holes or through holes, are formed in the surface of a thicker section to receive a spindle an inch or more outside of the now-covered-up conventional hole. Generally, the spindle is telescopic and spring-biased in one of the conventional fashions; i.e., the spindle pin itself may be telescopically depressible into the spindle body or the spindle itself can be made into two pieces which telescope over one another and are held apart by means of a spring, both designs being conventional.

In the preferred form, the spindle receptacle holes are formed with two distinct diameter portions, a first, larger diameter hole portion which is closest to the inside surface of the extender and a second, smaller diameter portion coaxial with the first portion but farther away from the inside surface. This double diameter arrangement accommodates spindles of different sizes as well as spindles with nibs on the outer surface.

Another aspect of the invention, usable in combination with the roll extenders described above, is a rigid plastic hollow cylinder designed to fit precisely within a cardboard core of a conventional toilet tissue roll. This hollow cylinder is used to advantage where shipment and packaging has flattened the cardboard cores or one or more rolls of a multi-roll package and effectively restores the core to round shape so as to coact more effectively with the spindle and roll more easily thereover.

These and other advantages of the present invention will be best understood from a reading of the following specification which is to be taken with the accompanying drawings.

BRIEF SUMMARY OF THE DRAWINGS

The description herein makes reference to the accompanying drawings wherein like reference numerals refer to like parts throughout the several views and wherein:

FIG. 1 is a perspective view of one embodiment of my invention as applied to a one-piece roll holder;

FIG. 2 is a perspective view of one of the extenders in the embodiment of FIG. 1;

FIG. 3 is a side view of a variation on the extender of FIG. 2;

DETAILED DESCRIPTION OF THE ILLUSTRATIVE EMBODIMENTS

Figure 4:
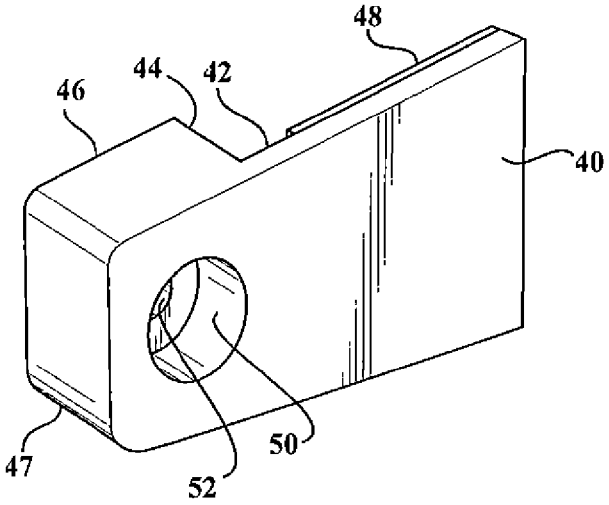
FIG. 4 is a perspective view of another extender with a multi-diameter spindle hole.

Referring to FIGS. 1-3, there is shown a toilet paper roll holder 10 of the type comprising a base 12 with integral forwardly extending arms 16, 18. The base plate 12 is secured to a wall, partition or the like by means of screws 14. Alternatives such as adhesive attachments or slide-in brackets can also be used. The arms 16, 18 are spaced approximately 5 inches apart, are parallel and extend generally at right angles to the base 12.

Receptacles 20 are formed proximate the distal ends of the arms 16, 18 to receive the pins 24 of a spindle 22 therebetween in normal use; i.e., before the holder 10 is modified as described below. A toilet paper roll can be mounted on the spindle 22 in conventional fashion. Spindle 22 is also called a "roller".

In accordance with the invention, capacity extenders 26, 28 are adhesively secured to the inside surfaces of the arms 16, 18 in such a way as to extend the spindle axis away from the base 12 by a distance $D_e$ such that the increased roll diameter capacity is represented by the quantity $D_c$.

As better shown in FIGS. 2 and 3, each extender comprises a molded plastic body having opposite surfaces 30, 32 and a blind hole receptacle 34 formed in the surface 32 near one of the opposite distal ends of each body. The outside surface 30 has a step 36 formed therein to help locate the body 26 on the end of the arm 16 as shown in FIG. 1 and to provide a smooth integrated appearance. A strip 38 of two-sided adhesive is secured to the surface 30 for attaching the extender 26 or 28 to the flat inside surface of the respective arms 16, 18. This attachment covers the normal spindle receptacles 20 and provides new locations 34 for receiving the spindle pins 24.

In use, the purchaser of the extenders 26, 28 removes a protective layer from the adhesive strip 38 and locates the extender, either 26 or 28 on the end of the appropriate arms 16, 18 with the adhesive against the flat inside surface of the original arm and the step 36 against the end of the arm. Thereafter, the spindle 22 is newly located in the receptacles 34, a distance $D_e$ away from the old axis of rotation. This distance may be typically on the order of one inch.

Figure 5:
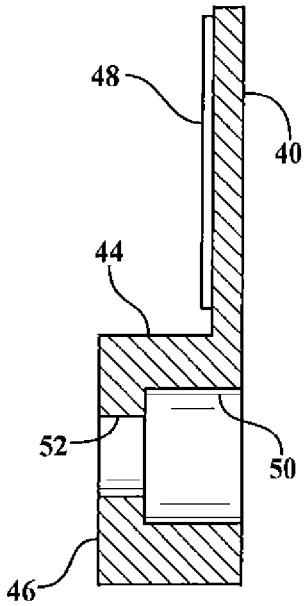
FIG. 5 is an side view of the extender of FIG. 4 illustrating in detail the arrangement of the two-diameter spindle hole configuration.

Referring now to FIGS. 4 and 5, there is shown a second embodiment of the extender in the form of a molded plastic body having a flat inside surface 40, a flat parallel outside surface 42 terminating in a shoulder 44 and a second flat surface 46 on a portion 47 of enlarged thickness. A spindle hole 50 is formed in the enlarged thickness portion 47. A strip of two-sided adhesive 48 is attached to the flat surface 42 so that the extender may be installed in the manner shown in FIG. 1 with the flat surface 42 and the adhesive strip 48 against the inside surface of the toilet tissue roll holder so that the surface 42 covers up the stock hole 20 of the conventional toilet tissue roll holder. The shoulder 44 butts up against the end of the extended arm 16 and the hole 50 receives the pin or axle portion of the spindle 22 as shown in FIG. 1.

As shown in FIG. 4, hole 50 is of a compound nature; it comprises a first larger diameter portion which opens to the surface 40 and a second smaller diameter portion which opens to the surface 46. Portions 50 and 52 are coaxial and contiguous. The result is the ability to accommodate spindles of various sizes and diameters therein.

Figure 6:
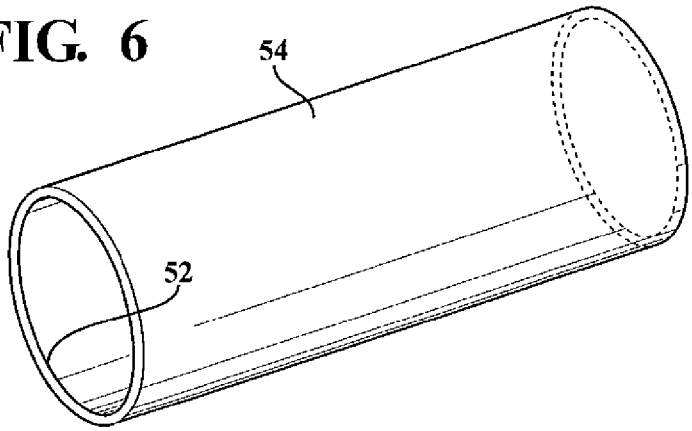
FIG. 6 is a perspective view of a toilet tissue roll core insert.
Figure 7:
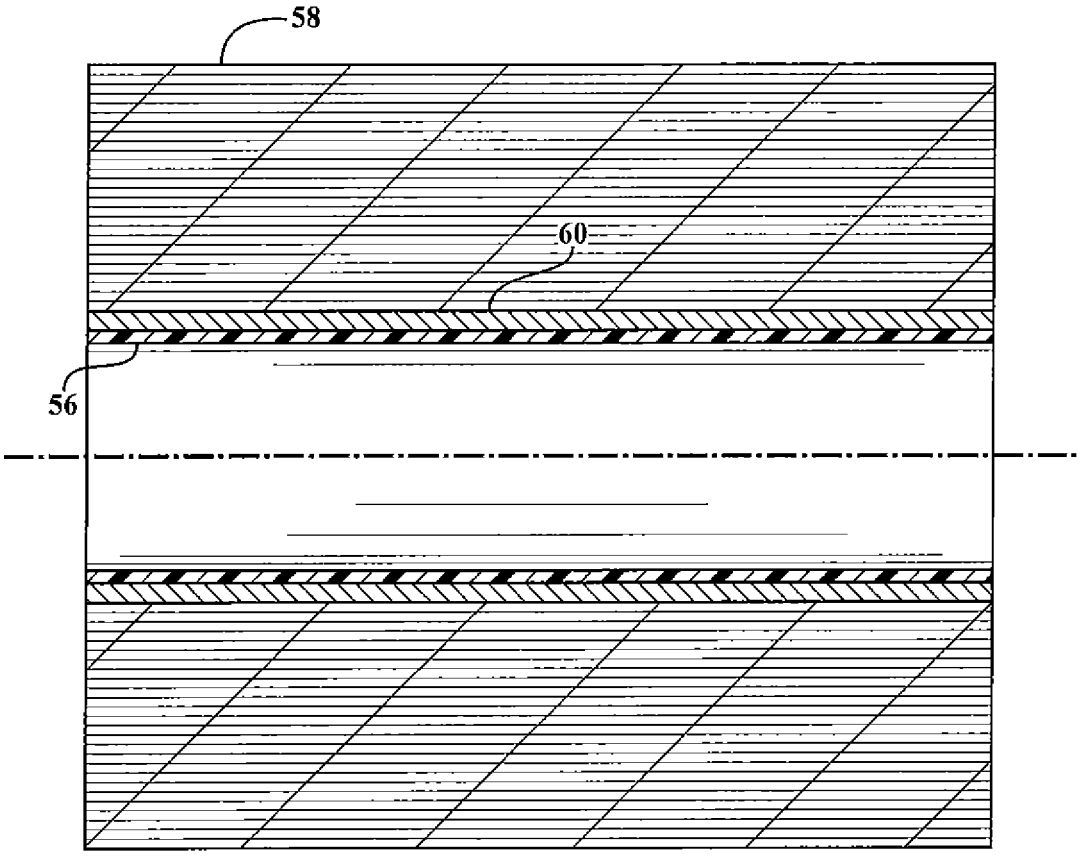
FIG. 7 is a sectional view of a roll of toilet tissue with the insert of FIG. 6 installed therein.

Referring now to FIGS. 6 and 7, there is shown a second implement which can be used to advantage either alone or with the extenders of FIGS. 1-5. This implement is a plastic hollow cylinder 54 having a through hole 56 adapted to fit snugly within the cardboard core 60 of a standard or jumbo roll 58 of toilet tissue. The cylinder 54 is preferably four or more inches long but not greater in length than the width of the toilet tissue roll 58 and on the order of 1⅝ inches in diameter. It is preferably made of an acrylic plastic or a clear polycarbonate but any relatively rigid, inexpensive material will do. With the dimensions described above, it fits snugly within the toilet tissue roll as shown in FIG. 7 to reconstitute and reshape a core 60 which has been flattened by the compression forces often experienced in packaging, shipping and storing of conventional bundles of toilet tissue rolls.

It is to be understood that the invention has been described with respect to preferred embodiments illustrating the invention or inventions in particular forms and shapes. These specific forms and shapes may be altered by the designer according to specific desired end results.

What is claimed is:

1. Apparatus for increasing the roll diameter capacity of a toilet tissue roll holder of the type having first and second opposed parallel arms, each of which has a flat inside surface and an end surface, the opposed parallel arms adapted to receive a spindle therebetween wherein the apparatus comprises:

a pair of molded plastic extender bodies that are fully separate from one another and each having substantially flat and parallel inside and outside surfaces, the outside surfaces being stepped and having a strip of adhesive secured thereto such that the outside surface may be attached flat against the inside surface of a toilet tissue roll holder arm so as to cover a spindle receptacle hole in said arm, the stepped outside surface having a shoulder which, in the installed condition, abuts the end surface of the toilet tissue roll holder arm to which the extender is attached, each extender having a spindle receiving hole formed in the inside surface to receive a spindle therein, wherein each spindle receiving hole is a compound hole having a first inside portion of a first axially constant diameter and a second contiguous and coaxial portion of a second axially constant smaller diameter wherein the first diameter portion extends only partially into the extender body and the second portion extends farther into the extender body, said compound holes each having a step defining a transition from the first diameter portion to the second diameter portion.

2. Apparatus as defined in claim 1 further comprising a shape-restoring toilet tissue roll core insert comprising a hollow, rigid plastic, open-ended cylinder having a length and a diameter to fit snugly and wholly within the cardboard core of a standard toilet tissue roll, the spindle extending through the hollow, rigid plastic cylinder and being rotatable relative thereto, said cylinder being unattached to the extender bodies.

* * * * *